US010657798B2

(12) United States Patent
Mullins et al.

(10) Patent No.: US 10,657,798 B2
(45) Date of Patent: May 19, 2020

(54) REPORTING HAZARDOUS CONDITION USING A MOBILE DEVICE

(71) Applicant: DAQRI, LLC, Los Angeles, CA (US)

(72) Inventors: Brian Mullins, Altadena, CA (US); Christopher Broaddus, Santa Clara, CA (US)

(73) Assignee: DAQRI, LLC, Los Angeles, CA (US)

( * ) Notice: Subject to any disclaimer, the term of this patent is extended or adjusted under 35 U.S.C. 154(b) by 0 days.

(21) Appl. No.: 15/852,190

(22) Filed: Dec. 22, 2017

(65) Prior Publication Data

US 2019/0197876 A1 Jun. 27, 2019

(51) Int. Cl.
*G08B 25/01* (2006.01)
*G08B 25/10* (2006.01)

(52) U.S. Cl.
CPC ..... *G08B 25/016* (2013.01); *G08B 25/10* (2013.01)

(58) Field of Classification Search
CPC ..... G06F 3/017; G06K 9/00369; G06T 17/05; G06T 19/006; G08B 17/10; G08B 21/12; G08B 21/182; G08B 25/002; G08B 25/008; G08B 25/016; G08B 25/10; G08B 29/02; G08B 29/185; H04L 12/282; H04L 67/12; H04M 1/72569; H04Q 9/00
USPC ..... 340/539.13
See application file for complete search history.

(56) References Cited

U.S. PATENT DOCUMENTS 5,159,315 A * 10/1992 Schultz ..... G08B 17/10 340/504
7,469,197 B2 * 12/2008 Tsujino ..... G01C 15/00 702/127
2007/0058634 A1 * 3/2007 Gupta ..... H04L 67/12 370/392
2007/0139183 A1 * 6/2007 Kates ..... G08B 25/005 340/521
2007/0208535 A1 * 9/2007 Misra ..... G01D 1/18 702/182
2010/0011062 A1 * 1/2010 Araki ..... B09C 1/10 709/205

(Continued)

OTHER PUBLICATIONS

Wikipedia, Short-term Exposure Limit; https://en.wikipedia.org/wiki/Short-term exposure limit; Jan. 21, 2019, 2 pages (Year: 2018).*

(Continued)

*Primary Examiner* — Stephen R Burgdorf

(74) *Attorney, Agent, or Firm* — Schwegman Lundberg & Woessner, P.A.

(57) ABSTRACT

Techniques of tracking a user's location are disclosed. In some embodiments, a mobile device captures first sensor data using at least one sensor, determines that a predetermined hazard criteria is not satisfied by an environment of a user of the mobile device, suppresses transmission of a representation of the captured first sensor data to a remote computing device based on the determination that the predetermined hazard criteria is not satisfied, captures second sensor data using the sensor(s), determines that the predetermined hazard criteria is satisfied by the environment of the user, and transmits a representation of the captured second sensor data to the remote computing device based on the determination that the predetermined hazard criteria is satisfied by the environment of the user.

19 Claims, 9 Drawing Sheets

(56) References Cited

U.S. PATENT DOCUMENTS

| | | | | |
|---|---|---|---|---|
| 2010/0271208 | A1* | 10/2010 | Steinmetz | F16P 3/147 340/572.1 |
| 2012/0158161 | A1* | 6/2012 | Cohn | G08B 29/02 700/90 |
| 2014/0260528 | A1* | 9/2014 | Schoell | G01N 33/225 73/19.01 |
| 2014/0284222 | A1* | 9/2014 | Wanek, Jr. | G01N 33/0065 205/780.5 |
| 2016/0094898 | A1* | 3/2016 | Primm | H04Q 9/00 340/870.09 |
| 2017/0041036 | A1* | 2/2017 | Phung | H04B 1/3888 |
| 2017/0099586 | A1* | 4/2017 | Corbin | H04L 67/12 |
| 2017/0124853 | A1* | 5/2017 | Mehta | H04W 4/90 |
| 2017/0330446 | A1* | 11/2017 | Thurlow | G08B 25/10 |
| 2018/0024091 | A1* | 1/2018 | Wang | H04B 1/713 204/431 |
| 2019/0132269 | A1* | 5/2019 | Nolan | H04L 51/046 |
| 2019/0250653 | A1* | 8/2019 | Conlon | G05B 15/02 |

OTHER PUBLICATIONS

"Apple Advances Next-Gen Live Indoor Mapping Technology based on Inertial Navigation", Patently Apple- Posted by Jack Purcher, [Online]. Retrieved from the Internet: <URL: http://www.patentlyapple.com/patently-apple/2016/12/apple-advances-next-gen-live-indoor-mapping-technology-based-on-inertial-navigation.html, (Dec. 1, 2016).

* cited by examiner

REPORTING HAZARDOUS CONDITION USING A MOBILE DEVICE

TECHNICAL FIELD

The present application relates generally to the technical field of data processing, and, in various embodiments, to methods and systems of tracking a user's location using a mobile device.

BACKGROUND

First responders (e.g., firefighters, paramedics, police officers, etc.) often need to find a person within a particular environment (e.g., within a building). In emergency situations, complete and precise information regarding a person's location are important. However, such information is often unavailable due to the technical challenges of determining a person's location within a complex environment, particularly when there is a limited amount of information about the environment or the information that is available is out of date.

BRIEF DESCRIPTION OF THE DRAWINGS

Some embodiments of the present disclosure are illustrated by way of example and not limitation in the figures of the accompanying drawings, in which like reference numbers indicate similar elements.

DETAILED DESCRIPTION

Figure 1:
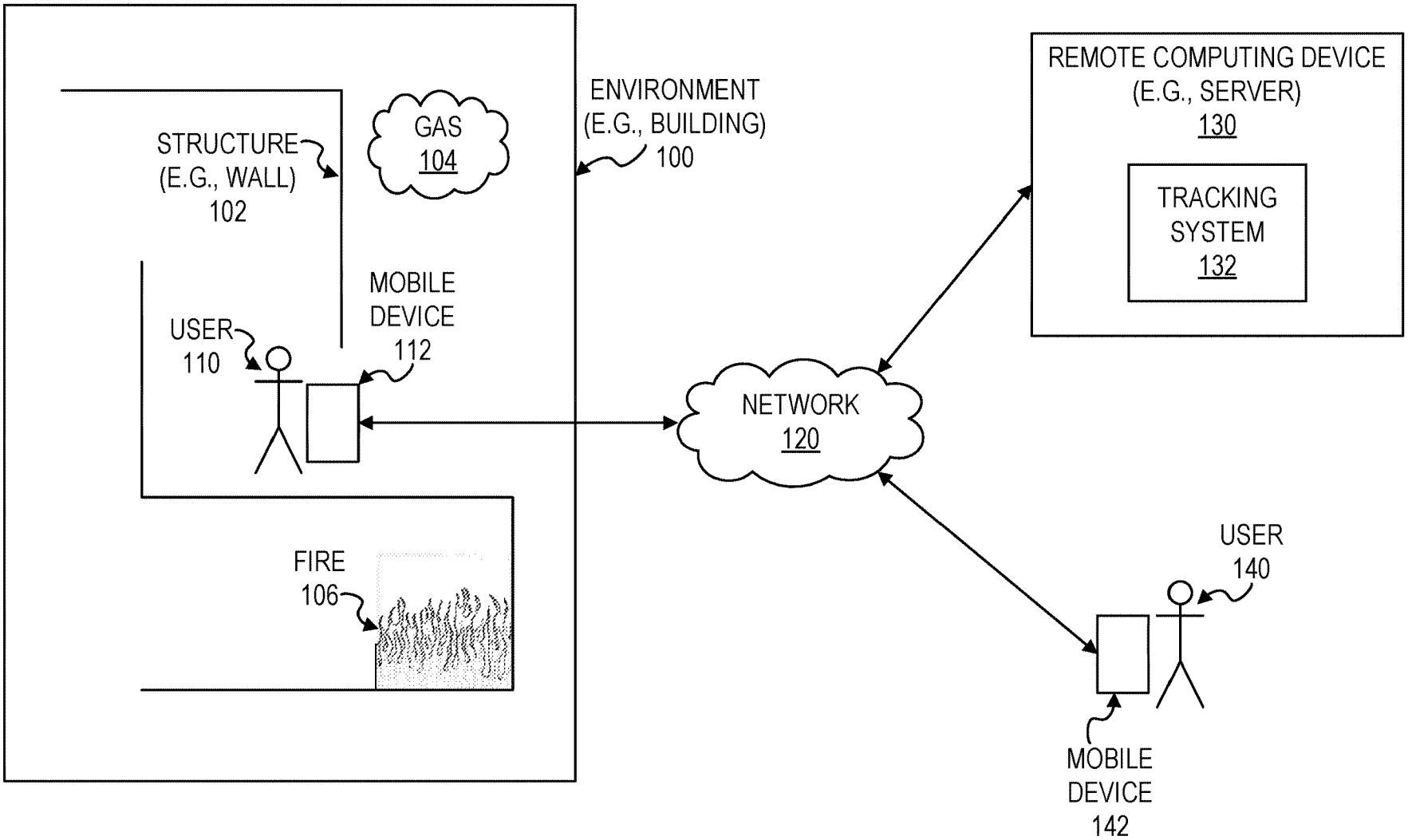
FIG. 1 is a block diagram illustrating a user within an environment, in accordance with some example embodiments.

Example methods and systems of tracking a user's location are disclosed. In the following description, for purposes of explanation, numerous specific details are set forth in order to provide a thorough understanding of example embodiments. It will be evident, however, to one skilled in the art that the present embodiments may be practiced without these specific details.

As will be disclosed herein, a mobile device may be configured to communicate positioning and other location-related data to a remote computing device in order to enable the remote computing device to track the location of the user of the mobile device, as well as to enable the remote computing device to understand the environment in which the user of the mobile device is situated. Furthermore, the mobile device may be configured to suppress transmission of data to the remote computing device until a particular criteria or threshold is satisfied, thereby significantly reducing the strain on the electronic resources (e.g., power) of the mobile device associated with frequent transmissions. Additionally, other technical solutions to technical problems will be apparent from this disclosure as well.

In some example embodiments, a mobile device captures first sensor data using at least one sensor of the mobile device, determines that a predetermined hazard criteria is not satisfied by an environment of a user of the mobile device, suppresses transmission of a representation of the captured first sensor data to a remote computing device based on the determination that the predetermined hazard criteria is not satisfied by the environment of the user, captures second sensor data using the at least one sensor of the mobile device, determines that the predetermined hazard criteria is satisfied by the environment of the user of the mobile device, and transmits a representation of the captured second sensor data to the remote computing device based on the determination that the predetermined hazard criteria is satisfied by the environment of the user of the mobile device.

In some example embodiments, the predetermined hazard criteria is configured to indicate that a hazardous condition is present within the environment of the user of the mobile device. In some example embodiments, the predetermined hazard criteria comprises at least one indication from a group of indication consisting of an indication that smoke has been detected, an indication that a predetermined threshold temperature has been exceeded, an indication that a flame has been detected, an indication that a particular gas has been detected, and an indication that radiation has been detected. In some example embodiments, the determining that the predetermined hazard criteria is satisfied by the environment of the user of the mobile device comprises receiving hazardous condition data from at least one detector from a group of detectors consisting of a smoke detector, a heat detector, a flame detector, a gas detector, a carbon monoxide detector, and a radiation detector, and determining that the predetermined hazard criteria is satisfied by the hazardous condition data.

In some example embodiments, the first sensor data comprises first inertial measurement unit (IMU), the second sensor data comprises second IMU data, and the at least one sensor comprises an IMU. In some example embodiments, the first sensor data further comprises first image data, the second sensor data further comprises second image data, and the at least one sensor further comprises at least one camera. In some example embodiments, the at least one detector is integrated into the mobile device. In some example embodiments, the mobile device comprises one of a physical badge, a smartphone, a tablet computer, a smartwatch, and a head-mounted display device.

In some example embodiments, the transmitting of the representation of the captured second sensor data to the remote computing device comprises identifying relevant sensor data based on a determination that the relevant sensor data was captured by the at least one sensor within a predetermined period of time, with the identified relevant sensor data comprising the first sensor data and the second sensor data, and transmitting a representation of the identified relevant sensor data to the remote computing device. In some example embodiments, the transmitting the representation of the identified relevant sensor data comprises compressing the identified relevant sensor data, and transmitting the compressed identified relevant sensor data to the remote computing device. In some example embodiments, the remote computing device comprises a remote server.

In some example embodiments, the mobile device captures third sensor data using the at least one sensor of the mobile device, determines that the third sensor data does not satisfy a predetermined threshold amount of data, suppresses transmission of a representation of the captured third sensor data to the remote computing device based on the determination that the third sensor data does not satisfy the predetermined threshold amount of data, captures fourth sensor data using the at least one sensor of the mobile device, determines that a combination of the third sensor data and the fourth sensor data satisfies the predetermined threshold amount of data, and transmits a representation of the combination of the third sensor data and the fourth sensor data to the remote computing device based on the determination that combination of the third sensor data and the fourth sensor data satisfy the predetermined threshold amount of data.

The methods or embodiments disclosed herein may be implemented as a computer system having one or more modules (e.g., hardware modules or software modules). Such modules may be executed by one or more processors of the computer system. The methods or embodiments disclosed herein may be embodied as instructions stored on a machine-readable medium that, when executed by one or more processors, cause the one or more processors to perform the instructions.

FIG. 1 is a block diagram illustrating a user 110 within an environment 100, in accordance with some example embodiments. In some example embodiments, the environment 100 comprises a building having multiple structures 102 (e.g., walls, doors, ceiling, etc.) that form boundaries, barriers, and pathways within which the user 110 may navigate. As the user 110 navigates through the environment 100, his or her mobile device 112 may capture sensor data related to the position of the user 110 within the environment 100. The mobile device 112 may then transmit a representation of the sensor data to a remote computing device 130, such as a server located outside of the environment 100. The remote computing device 130 may be configured to use the sensor data to track the position of the user 110 within the environment 100, as well as to generate or update a map of the environment 100. The remote computing device 130 may then transmit the position data of the user, as well as the map of the environment 100, to one or more mobile devices 142 (or other computing devices) of one or more other users 140, such as to one or more first responders. It is also contemplated that the mobile device 112 of the user 110 may transmit the sensor data to the mobile device(s) 142 of the other user(s) 140, and that the mobile device(s) 142 of the other user(s) 140 may be configured to use the sensor data to track the position of the user 110 within the environment 100, as well as to generate or update a map of the environment 100.

Communication of data between the mobile device 112 of the user 112 within the environment 100, the remote computing device 130, and the mobile device(s) 142 of the other user(s) 140 can be achieved via communication over a network 120. Accordingly, mobile device 112, the remote computing device 130, and the mobile device(s) 142 can be part of a network-based system (e.g., a cloud-based server system). However, it is contemplated that other configurations are also within the scope of the present disclosure. The network 120 may be any network that enables communication between or among machines, databases, and devices. Accordingly, the network 120 may be a wired network, a wireless network (e.g., a mobile or cellular network), or any suitable combination thereof. The network may include one or more portions that constitute a private network, a public network (e.g., the Internet), or any suitable combination thereof.

Figure 2:
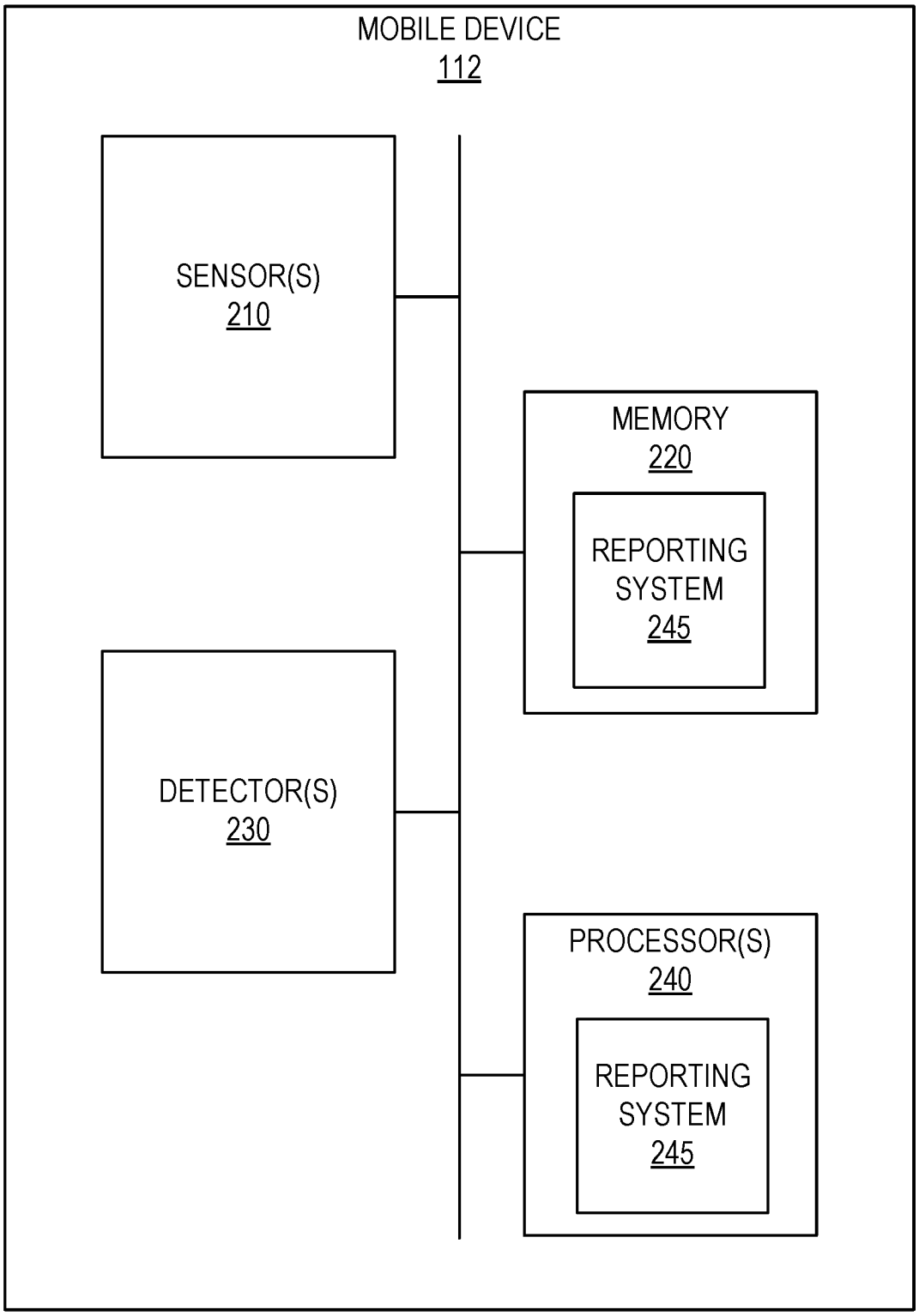
FIG. 2 is a block diagram illustrating a mobile device configured to be used in tracking the location of a user, in accordance with some example embodiments.

FIG. 2 is a block diagram illustrating a mobile device 112 configured to be used in tracking the location of a user 110, in accordance with some example embodiments. In some example embodiments, the mobile device 112 comprises one of a physical badge (e.g., a badge worn by employees of a company to gain access to a certain area), a smartphone, a tablet computer, a smartwatch, a head-mounted display device, and other wearable computing devices. However, it is contemplated that other types of mobile devices 112 are also within the scope of the present disclosure. In some example embodiments, the mobile device 112 comprises, among other things, one or more sensors 210, memory 220, one or more detectors 230, and one or more hardware processors 240 communicatively coupled to each other.

The sensor(s) 210 may include one or more image capture devices, one or more proximity sensors, one or more audio sensors, one or more inertial sensors, and a Global Positioning System (GPS) receiver, or any combination thereof. In some example embodiments, the image capture device(s) comprises a built-in camera or camcorder with which a user of the mobile device 112 can use to capture image data of visual content in a real-world environment (e.g., a real-world physical object). The image data may comprise one or more still images or video. In some example embodiments, the proximity sensor(s) is configured to detect the presence of nearby objects without any physical contact, such as by emitting an electromagnetic field of a beam of electromagnetic radiation (e.g., infrared) and looking for changes in the field or return signal. In some example embodiments, the audio sensor(s) comprises a microphone or some other device configured to capture audio data. In some example embodiments, the inertial sensor(s) comprises an inertial measurement unit (IMU) sensor, such as an accelerometer and/or a gyroscope, with which a position and orientation of the mobile device 112 can be tracked over time. For example, the inertial sensor(s) can measure an angular rate of change and linear acceleration of the mobile device 112. It is contemplated that other sensors are also within the scope of the present disclosure. In some example embodiments, sensor data captured and/or generated by the sensor(s) 210 is stored in memory 220 for subsequent processing and/or transmission. In some example embodiments, the GPS receiver is configured to use an antenna on the mobile device 112 to receive GPS signals for use in determining the position of the mobile device 112.

In some example embodiments, the detector(s) 230 comprises any combination of one or more of a smoke detector, a heat detector, a flame detector, a gas detector, a carbon monoxide detector, and a radiation detector. The smoke detector may comprise a device that senses smoke, typically as an indicator of fire (e.g., fire 106 in FIG. 1), and generates a signal or other indication in response to sensing smoke. The heat detector may comprise a device designed to generate a signal or other indication when the thermal energy of an environment (e.g., caused by a fire in the environment) increases the temperature of a heat sensitive element beyond a particular threshold temperature. The flame detector may comprise a device designed to detect the presence of a flame or fire, such as by using optical detectors, and generate a signal or other indication in response to detecting the flame or fire. The gas detector may comprise a device configured to detect combustible, flammable and toxic gases (e.g., gas 104 in FIG. 1), as well as oxygen depletion, and generate a signal or other indication in response to the detection of such gases. The carbon monoxide detector may comprise a device that detects the presence of carbon monoxide gas and generates a signal or other indication in response to detecting the present of carbon monoxide gas. A radiation detector, or particle detector, may comprise a device configured to detect, track, and/or identify ionizing particles, such as those produced by nuclear decay, cosmic radiation, or reactions in a particle accelerator. Such radiation or particle detectors can measure particle energy and other attributes, such as momentum, spin, and charge, in addition to merely registering the presence of the particle. It is contemplated that other types of detectors are also within the scope of the present disclosure.

In some example embodiments, a reporting system 245 is stored in memory 220 and/or implemented as part of the hardware of the processor(s) 240, and is executable by the processor(s) 240. The reporting system 245 is configured to perform operations for communicating positioning and other location-related data to remote computing device 130 (or another mobile device 142) in order to enable the remote computing device 130 (or another mobile device 142) to track the location of the user 110 of the mobile device 112, as well as to enable the remote computing device 130 (or another mobile device 142) to understand the environment in which the user 110 of the mobile device 112 is situated.

Figure 3:
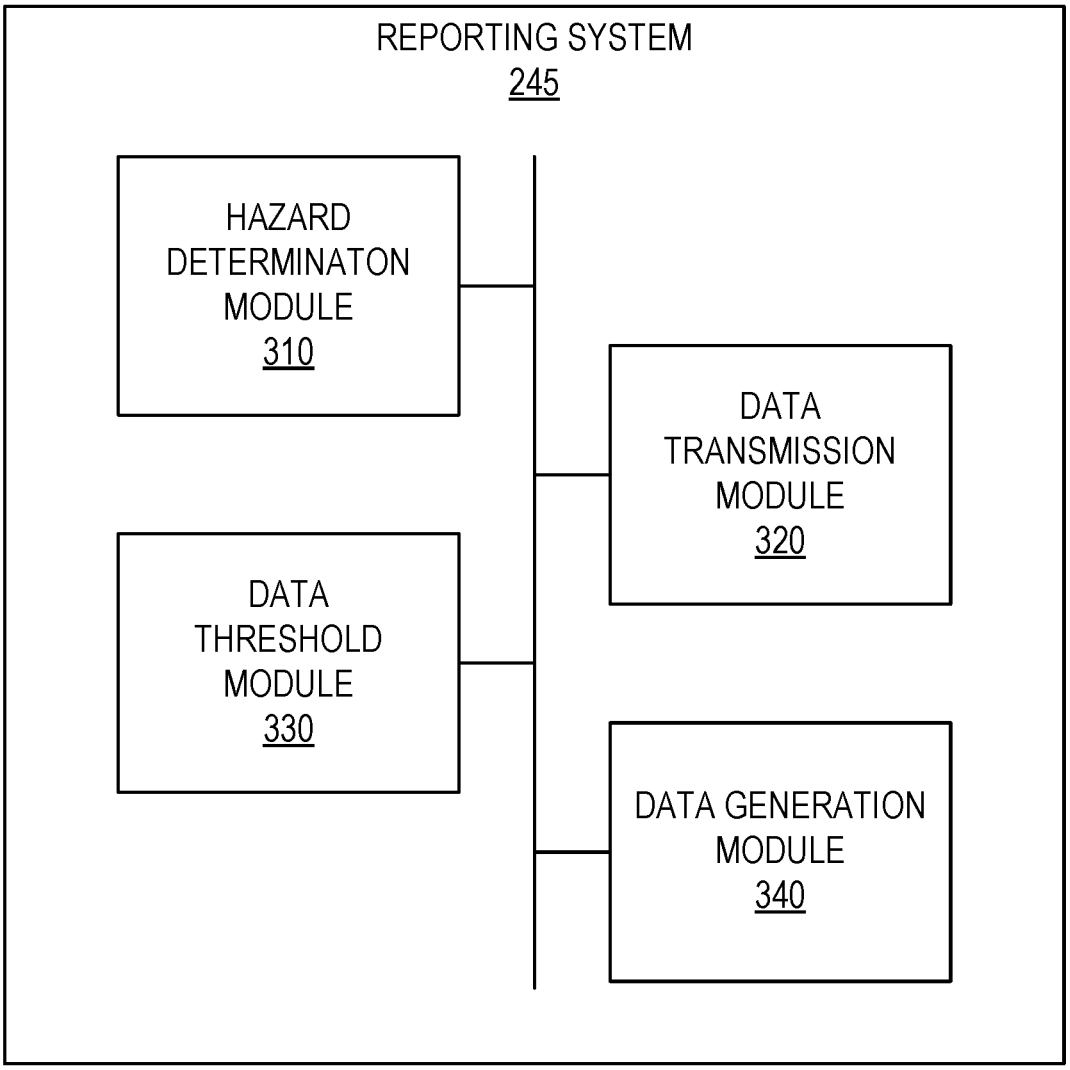
FIG. 3 is a block diagram illustrating components of a reporting system, in accordance with some example embodiments.

FIG. 3 is a block diagram illustrating components of reporting system 245, in accordance with some example embodiments. In some example embodiments, reporting system 245 comprises any combination of one or more of a hazard determination module 310, a data transmission module 320, a data threshold module 330, and a data generation module 340. The hazard determination module 310, the data transmission module 320, the data threshold module 330, and the data generation module 340 may be communicatively coupled to one another.

In some example embodiments, the hazard determination module 310 is configured to determine whether or not a predetermined hazard criteria is satisfied by the environment 100 of the user 110 of the mobile device 112. The predetermined hazard criteria may be configured to indicate that a hazardous condition is present within the environment 100 of the user 110 of the mobile device 112. For example, the predetermined hazard criteria may comprise one of an indication that smoke has been detected, an indication that a predetermined threshold temperature has been exceeded, an indication that a flame has been detected, an indication that a particular gas (e.g., carbon monoxide) has been detected, and an indication that radiation has been detected. In some example embodiments, the hazard determination module 310 is configured to receive hazardous condition data from the detector(s) 230, and to make its determination of whether or not the predetermined hazard criteria has been satisfied based on such hazardous condition data. The hazardous condition data indicates the indications generated by the detector(s) 230, as well as the lack of such indications generated by the detector(s) 230 in situations where no hazardous conditions (e.g., smoke, fire, carbon monoxide, radiation, etc.) have been detected.

In some example embodiments, the data transmission module 320 is configured to transmit a representation of sensor data captured by the sensor(s) 210 of the mobile device 112. The representation of the sensor data may comprise the sensor data itself, a compressed version of the sensor data, or some other modified version of the sensor data which can be used by the remote computing device 130 to track the location of the user 110 of the mobile device 112 and to enable the remote computing device 130 to understand the environment 100 in which the user 110 of the mobile device 112 is situated.

In some example embodiments, the data transmission module 320 is configured to suppress transmission of a representation of the sensor data to the remote computing device 130 based on a determination that the predetermined hazard criteria is not satisfied by the environment 100 of the user 110 of the mobile device 112, and to transmit a representation of the sensor data to the remote computing device 130 based on a determination that the predetermined hazard criteria is satisfied by the environment 100 of the user 110 of the mobile device 112. In this respect, the data transmission module 320 may conserve the electronic resources (e.g., power) of the mobile device 112 by conditioning transmission of the sensor data to the remote computing device 130 on certain criteria being met. In situations where the transmission of a representation of the sensor data is suppressed, the representation of the sensor data may still be stored in memory for subsequent inclusion in a transmission to the remote computing device 130 based on a subsequent determination that the predetermined hazard criteria is satisfied.

In some example embodiments, when transmitting a representation of sensor data to the remote computing device 130 (or other mobile device 142) in response to or otherwise based on a determination that the predetermined hazard criteria has been satisfied, the data transmission module 320 is configured to identify relevant sensor data to include in the representation of sensor data to be transmitted. Sensor data may be identified as relevant based on a determination that the sensor data was captured by the sensor(s) 210 within a predetermined period of time, which may be indicated by corresponding timestamps stored in association with the captured sensor data in memory 220. For example, the data transmission module 320 may identify all sensor data that has been captured by the sensor(s) 210 within the last 5 minutes as being relevant. As a result of this identification, sensor data captured at different times may be combined into a single transmission to the remote computing device 130. In some example embodiments, the data transmission module 320 is configured to compress the identified relevant sensor data, and then transmit the compressed identified relevant sensor data to the remote computing device 130 (or other mobile device 142).

In addition or as an alternative to conditioning transmission of the sensor data to the remote computing device 130 on hazard criteria being satisfied, in some example embodiments, the data transmission module 320 is configured to suppress transmission of a representation of the sensor data to the remote computing device 130 (or other mobile device 142) in response to or otherwise based on a determination that the sensor data does not satisfy a predetermined threshold amount of data, and to transmit a representation of the sensor data to the remote computing device 130 (or other mobile device 142) in response to or otherwise based on a determination that the sensor data satisfies the predetermined threshold amount of data. Such conditioning of the transmission of a representation of the sensor data upon a predetermined threshold amount of data being satisfied may help conserve electronic resources (e.g., power) of the mobile device 112, especially when the sensor data is to be used in forming or updating a map or other understanding of the environment 100 within which the user 110 is situated. Since a large amount of sensor data may be required to form or update a map of the environment 100, transmitting sensor data immediately every time it is captured by the sensor(s) 210 of the mobile device 112 may undesirably consume a significant amount of electronic resources.

In some example embodiments, the data threshold module 330 is configured to determine whether or not the predetermined threshold amount of data is satisfied by the sensor data. The predetermined amount of data may comprise a minimum size of the data (e.g., at least 10 megabytes). However, it is also contemplated that the predetermined amount of data may comprise a minimum amount of area or territory represented in the sensor data (e.g., at least a continuous 30 foot traversal).

In some example embodiments, the data threshold module 330 may omit sensor data that is determined to have already been captured and/or transmitted to the remote computing device 130 (or the other mobile device 142) or that is determined to be sufficiently similar to sensor data that has already been captured and/or transmitted to the remote computing device 130 (or the other mobile device 142) from its determination of whether the predetermined threshold amount of data has been satisfied. In this respect, if the sensor(s) 210 of the mobile device 112 has already captured sensor data of a 40-foot span of a particular hallway in a building on one day and then subsequently captures sensor data of the same 40-foot span of the same hallway two days later, the data threshold module 330 may compare the more recently captured sensor data of the 40-foot span with the older sensor data of the 40-foot span that is stored in memory 220 and determine that there is sufficient similarity between the two sensor data to omit the more recently captured sensor data from the calculation in determining whether the predetermined threshold amount of data has been satisfied.

Furthermore, in some example embodiments, the data transmission module 320 may also be configured to consider the similarity between sensor data in determining what sensor data to transmit to the remote computing device 130 (or other mobile device 142). In this respect, the data transmission module 320 may avoid repeatedly transmitting sensor data of the same portion of the environment 100 in separate transmissions, as well as avoid transmitting duplicates (or more) of sensor data of the same portion of the environment 100 in a single transmission.

Figure 4:
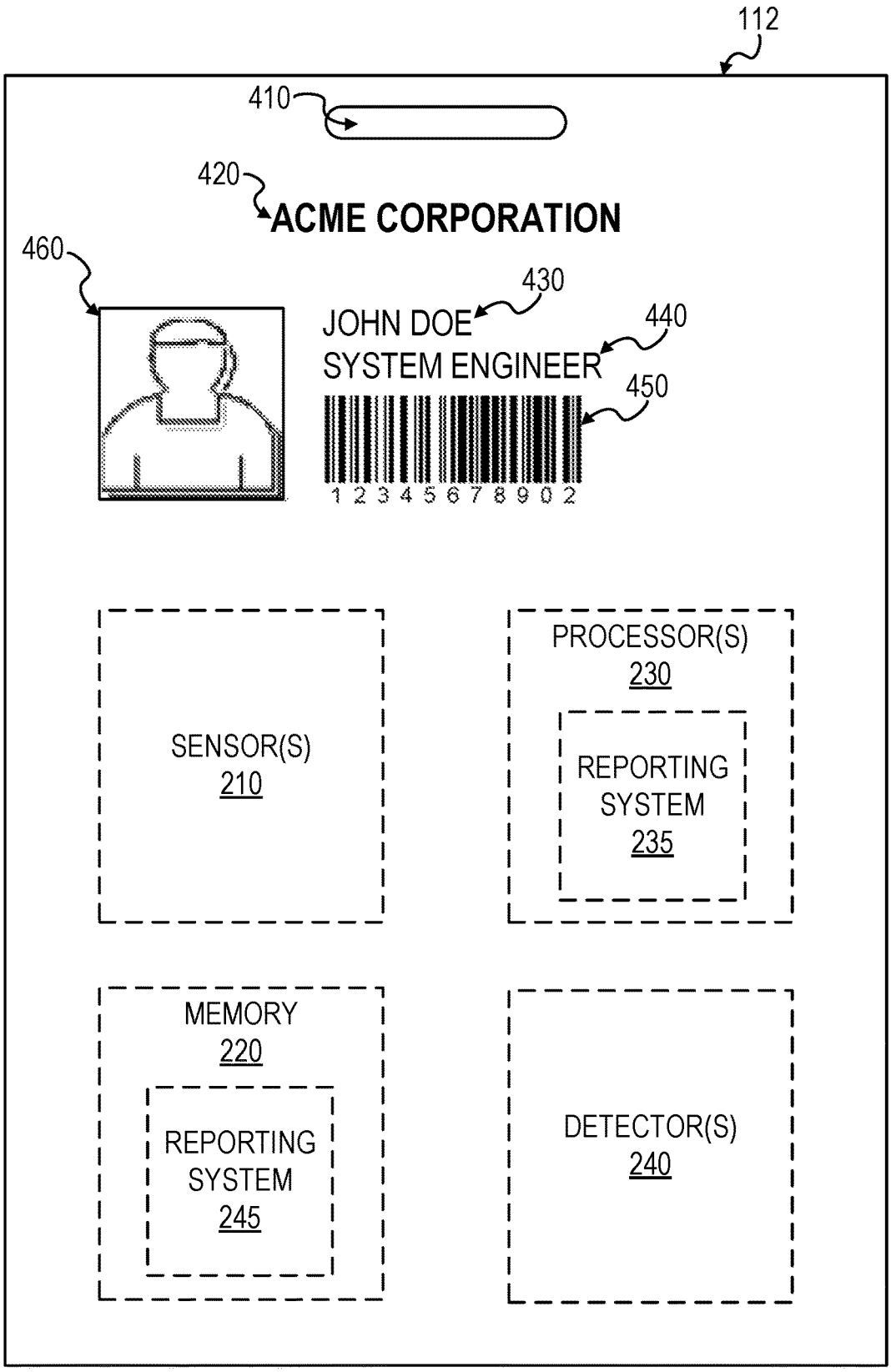
FIG. 4 illustrates a physical badge configured to be used in tracking the location of a user, in accordance with some example embodiments.

FIG. 4 illustrates a physical badge 400 configured to be used in tracking the location of a user 110, in accordance with some example embodiments. The mobile device 112 of the user 110 may comprise such a physical badge 400. In some example embodiments, the physical badge 400 comprises a tangible substrate material (e.g., plastic) and is configured to be worn by the user 110 (e.g., using a clip or chain secured to the physical badge via an aperture 410). The physical badge 400 may comprise an identification 420 of an organization, as well as one or more forms of identification of the user 110, such as a name 430, a bar code 450, and a picture 460 of the user 110. The physical badge 400 may also comprise a job title or other role 440 within an organization. In some example embodiments, the physical badge is configured to be used to grant access to the user 110 to one or more areas of the environment 100, such as by the bar code 450 being scanned by a security system for authentication or authorization.

In some example embodiments, the physical badge 400 comprises any combination of one or more of the sensor(s) 210, the memory 220, the detector(s) 230, the hardware processor(s) 240, and the reporting system 245, including the functionality of such components disclosed herein. As a result, the user 110 may participate in the tracking of his or her location, as well as the generation or updating of a map of the environment 100, simply by wearing the physical badge 400.

Figure 5:
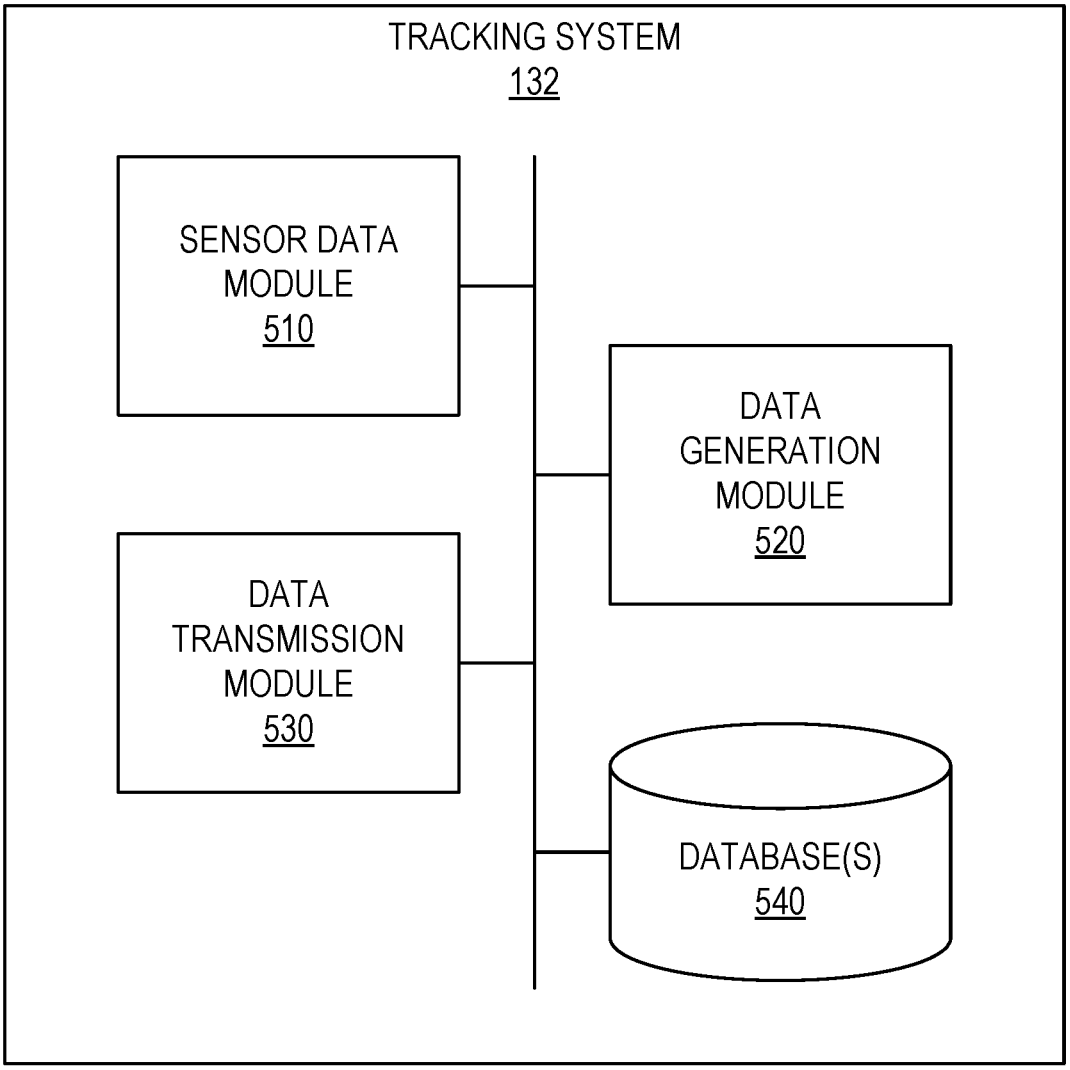
FIG. 5 is a block diagram illustrating a tracking system configured to be used in tracking the location of a user, in accordance with some example embodiments.

FIG. 5 is a block diagram illustrating a tracking system 132 configured to be used in tracking the location of a user 110, in accordance with some example embodiments. The tracking system 132 may be incorporated in the remote computing device 130, as seen in FIG. 1, or in another mobile device 142 of another user 140. In some example embodiments, the tracking system 132 comprises any combination of one or more of a sensor data module 510, a data generation module 520, a data transmission module 530, and one or more databases 540, which may all be communicatively coupled to one another.

In some example embodiments, the sensor data module 510 is configured to receive representations of sensor data from the mobile device 110 and store the representations of sensor data in the database(s). The sensor data module 510 may store the representations of sensor data in association with the user 110 of the mobile device 112 from which the representations of sensor data were transmitted. Additionally, the sensor data module 510 may store the representations of sensor data in association with the environment 100 within which the sensor data was captured. In this respect, the tracking system 132 may not only keep track of sensor data that corresponds to a particular user 110, but may also keep track of sensor data that corresponds to a particular environment 100, such that sensor data captured within the same environment 100 by different mobile devices of different users within that same environment may be grouped together in association with the same environment 100 in the database(s) 540. Such association of sensor data of the same environment from mobile devices of different users may be used by the tracking system to generate and/or update a map of the environment 100 by crowdsourcing sensor data from multiple users, thereby increasing the amount of sensor data corresponding to the environment 100 that is obtained by the tracking system 132, as well as increasing the speed at which such sensor data is obtained by the tracking system 132.

In some example embodiments, the data generation module 520 is configured to process the representations of sensor data received by the sensor data module 510 and stored in the database(s) 540, and to generate data based on those representations of sensor data. The data generation module 520 may be configured to determine the absolute position or relative position of the mobile device 112 in space using a plurality of video frames captured with at least one camera of the mobile device 112 and IMU data captured with at least one IMU sensor of the mobile device 112. In some example embodiments, the data generation module 520 tracks features in the plurality of video frames for each camera, synchronizes and aligns the plurality of video frames for each camera with the IMU data, and then computes a dynamic state of the mobile device 112 based on the synchronized plurality of video frames with the IMU data. The data generation module 520 may generates position data of the mobile device 112, and consequently the user 110 of the mobile device 112, as well as structures 102 of the environment 100 based on the dynamic state of the mobile device 112.

In some example embodiments, the IMU data includes a measurement of an angular rate of change and a measurement of linear acceleration. The features tracked by the data generation module 530 may include stationary interest points and line features in the world, and the dynamic state of the mobile device 112 may include position data, orientation data, GPS data, gyroscope data, accelerometer data, gyroscope bias and scale data, and accelerometer bias and scale data. In some example embodiments, the dynamic state is updated on every frame from at least one camera in real-time.

In some example embodiments, the data generation module 520 computes the position and orientation of the mobile device 112. The data generation module 520 may use stationary points tracked over time and the gyroscope and accelerometer data over time to solve for the position and orientation of the mobile device 112. The stationary points may be used as constraints with the inertial information to compute the position and orientation of the mobile device 112.

In some example embodiments, the data generation module 520 accesses the following data in order to compute the position and orientation of the mobile device 112 in space over time:

Stationary world points $(x_i, y_i, z_i)$ where i represents the $i^{th}$ world point, Gyroscope measurements $(g_{xt}, g_{yt}, g_{zt})$, Accelerometer measurements $(a_{xt}, a_{yt}, a_{zt})$, Gyroscope bias $(bg_{xt}, bg_{yt}, bg_{zt})$ and Accelerometer bias $(ba_{xt}, ba_{yt}, ba_{zt})$ where t is time.

The data generation module 520 may generate a 3D map that consists of an (x,y,z) for each stationary point in the real physical world being tracked. In some example embodiments, the data generation module 520 includes an algorithm that combines inertial information from the inertial sensor(s) and one or more image capture device(s) of the mobile device 112 in close proximity.

The sensor data captured by the mobile device 112 and transmitted to the tracking system 132 may include sensor data, such as image data, of identifiable objects such as a 2D physical object (e.g., a picture), a 3D physical object (e.g., a factory machine), a location (e.g., at the bottom floor of a factory), or any references (e.g., perceived corners of walls or furniture) in the environment 100. In some example embodiments, the data generation module 520 is configured to perform computer vision recognition techniques to determine corners, objects, lines, and letters captured within the sensor data, which can then be used by the data generation module 520 to piece together portions of the environment 100 to form or update a map of the environment 100.

In some example embodiments, the sensor data captured by the inertial sensor(s) of the mobile device 112 and the image capture device(s) of the mobile device 112 are used by the data generation module 520 to track features in the video images. The image features may be corner or blob features extracted from the image. For example, first and second local patch differentials over the image may be used to find corner and blob features. The tracked image features may be used to infer 3D geometry of the environment and may be combined with the inertial information to estimate position and orientation of the mobile device 112. In some example embodiments, the 3D location of a tracked point is computed by triangulation that uses the observation of the 3D point in all cameras over time. The 3D estimate is improved as additional evidence or data is accumulated over time.

In some example embodiments, the data generation module 520 is configured to analyze the sensor data received from the mobile device 112, such as any combination of one or more of image data, position data (e.g., IMU data, GPS data), and depth sensor data, and determine the location of the mobile device 112, and thus the user 110 of the mobile device 112, based on the analysis. This determined location information may then be stored in the database(s) 540 in association with an identification of the user 110 for later retrieval when location information of the user 110 is requested or otherwise desired.

In some example embodiments, the data generation module 520 is configured to analyze the sensor data received from the mobile device 112, such as any combination of one or more of image data, position data (e.g., IMU data, GPS data), and depth sensor data, and generate or update a map of the environment based on the analysis. For example, the data generation module 520 may identify sensor data corresponding to different positions within the environment 100, and use such sensor data that indicates a structure 102 (e.g., a wall) of the environment 100, as well as indicates the characteristics (e.g., length, width, height, type of material) of the structure 102, to generate or update a map of the environment 100 with such indications. In some example embodiments, the data generation module 520 is configured to stitch together such sensor data from different mobile devices 112 of different users 110 within the environment 100, thus crowdsourcing sensor data captured at different times by different mobile devices 112 of different users 110 to generate and update a map of the environment 100. The data generation module 520 may analyze the different sensor data to find similarities and/or continuity in the structures 102 indicated in the different sensor data in order to find overlaps or connecting points where gaps in the map can be filled. Additionally, structural changes in the environment 100 (e.g., a wall being torn down or a wall being constructed) may be detected by the data generation module 520 based on a comparison of newly received sensor data (e.g., image data) corresponding to a specific location in the environment 100 with older previously received sensor data corresponding to the same or sufficiently similar location in the environment 100.

In some example embodiments, the features discussed above with respect to the data generation module 520 can similarly be employed by a data generation module 340 in the reporting system 245 on the mobile device 112. As a result, the data transmission module 320 on the mobile device 112 may transmit the generated data, such as the location of the user 110 and/or a map of the environment 100, to the remote computing device 130 and/or directly to a mobile device 142 of another user 140 (e.g., a first responder).

In some example embodiments, the data transmission module 530 is configured to transmit data identifying or otherwise indicating the location of a user 110 to a computing device, such as a mobile device 142, of one or more other users 140. The data transmission module 530 may also transmit data of the generated or updated map of the environment 100 to the computing device of the other user(s) 140. In some example embodiments, such transmission of location data of the user 110 and map data of the environment 100 of the user 110 is triggered by a determination by the data transmission module 530 that a hazardous condition is present in the environment 100. For example, the data transmission module 320 on the mobile device 110 may be configured to transmit data from the detector(s) 230 to the tracking system 132, and the data transmission module 530 may then analyze the data from the detector(s) 230 to determine if a predetermined threshold indicating the presence of a hazardous condition has been met by the data. In response to, or otherwise based on, a determination by the data transmission module 530 that the predetermined threshold indicating the presence of a hazardous condition has been met by the data, the data transmission module 530 may transmit the location data of the user 110 and/or the map data of the environment 100 of the user 100 to the mobile device 142 of one or more other users 140.

Figure 6:
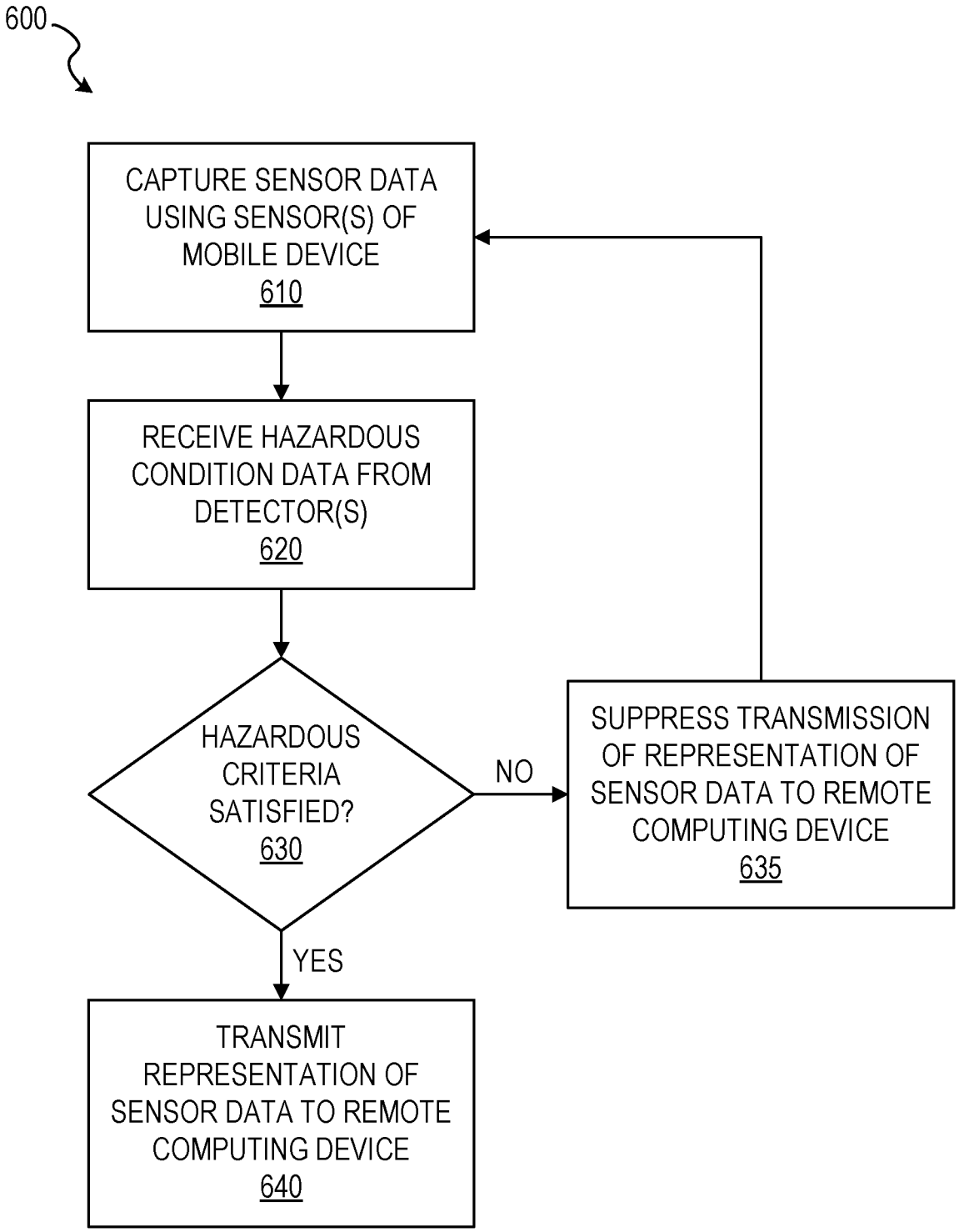
FIG. 6 is a flowchart illustrating a method of reporting location information of a user, in accordance with some example embodiments.

FIG. 6 is a flowchart illustrating a method 600 of reporting location information of a user 110, in accordance with some example embodiments. Method 600 can be performed by processing logic that can comprise hardware (e.g., circuitry, dedicated logic, programmable logic, microcode, etc.), software (e.g., instructions run on a processing device), or a combination thereof. In one example embodiment, the method 600 is performed by the reporting system 245 of FIGS. 2 and 3, or any combination of one or more of its components or modules, as described above.

At operation 610, the mobile device 112 captures sensor data using at least one sensor 210. In some example embodiments, the sensor data comprises one or more IMU data and the sensor(s) 210 comprises at least one IMU. In some example embodiments, the sensor data further comprises one or more image data and the sensor(s) 210 further comprises at least one camera.

At operation 620, the reporting system 245 receives hazardous condition data from at least one detector 230 of the mobile device 112. In some example embodiments, the detector(s) 230 is integrated into the mobile device and comprises one of a physical badge, a smartphone, a tablet computer, a smartwatch, and a head-mounted display device.

At operation 630, the reporting system 245 determines whether or not a predetermined hazard criteria is satisfied by an environment 100 of a user 110 of the mobile device 112 based on the hazardous condition data.

In some example embodiments, the predetermined hazard criteria is configured to indicate that a hazardous condition is present within the environment of the user of the mobile device. In some example embodiments, the predetermined hazard criteria comprises at least one indication from a group of indication consisting of an indication that smoke has been detected, an indication that a predetermined threshold temperature has been exceeded, an indication that a flame has been detected, an indication that a particular gas has been detected, and an indication that radiation has been detected. In some example embodiments, the determining whether the predetermined hazard criteria is satisfied by the environment of the user of the mobile device comprises receiving hazardous condition data from at least one detector from a group of detectors consisting of a smoke detector, a heat detector, a flame detector, a gas detector, a carbon monoxide detector, and a radiation detector, and then determining whether the predetermined hazard criteria is satisfied by the hazardous condition data.

If, at operation 630, it is determined that the predetermined hazard criteria is not satisfied by the environment 100 of the user 110 of the mobile device 112, then the reporting system 245 suppresses transmission of a representation of the sensor data to a remote computing device 130 at operation 635. In some example embodiments, the reporting system 245 stores the sensor data in memory 220. The method 600 may then return to operation 610, where additional sensor data is captured using the sensor(s) 210 of the mobile device 112.

If, at operation 630, it is determined that the predetermined hazard criteria is satisfied by the environment 100 of the user 110 of the mobile device 112, then the reporting system 245 transmits a representation of the sensor data to the remote computing device 130 at operation 640.

In some example embodiments, the transmitting of the representation of the sensor data to the remote computing device 130 comprises identifying relevant sensor data based on a determination that the relevant sensor data was captured by the sensor(s) 210 within a predetermined period of time, and transmitting a representation of the identified relevant sensor data to the remote computing device 130. In some example embodiments, the identified relevant sensor data comprises the multiple different sensor data captured at different times. In some example embodiments, the transmitting the representation of the identified relevant sensor data comprises compressing the identified relevant sensor data, and transmitting the compressed identified relevant sensor data to the remote computing device 130. In some example embodiments, the remote computing device 130 comprises a remote server.

It is contemplated that any of the other features described within the present disclosure can be incorporated into method 600.

Figure 7:
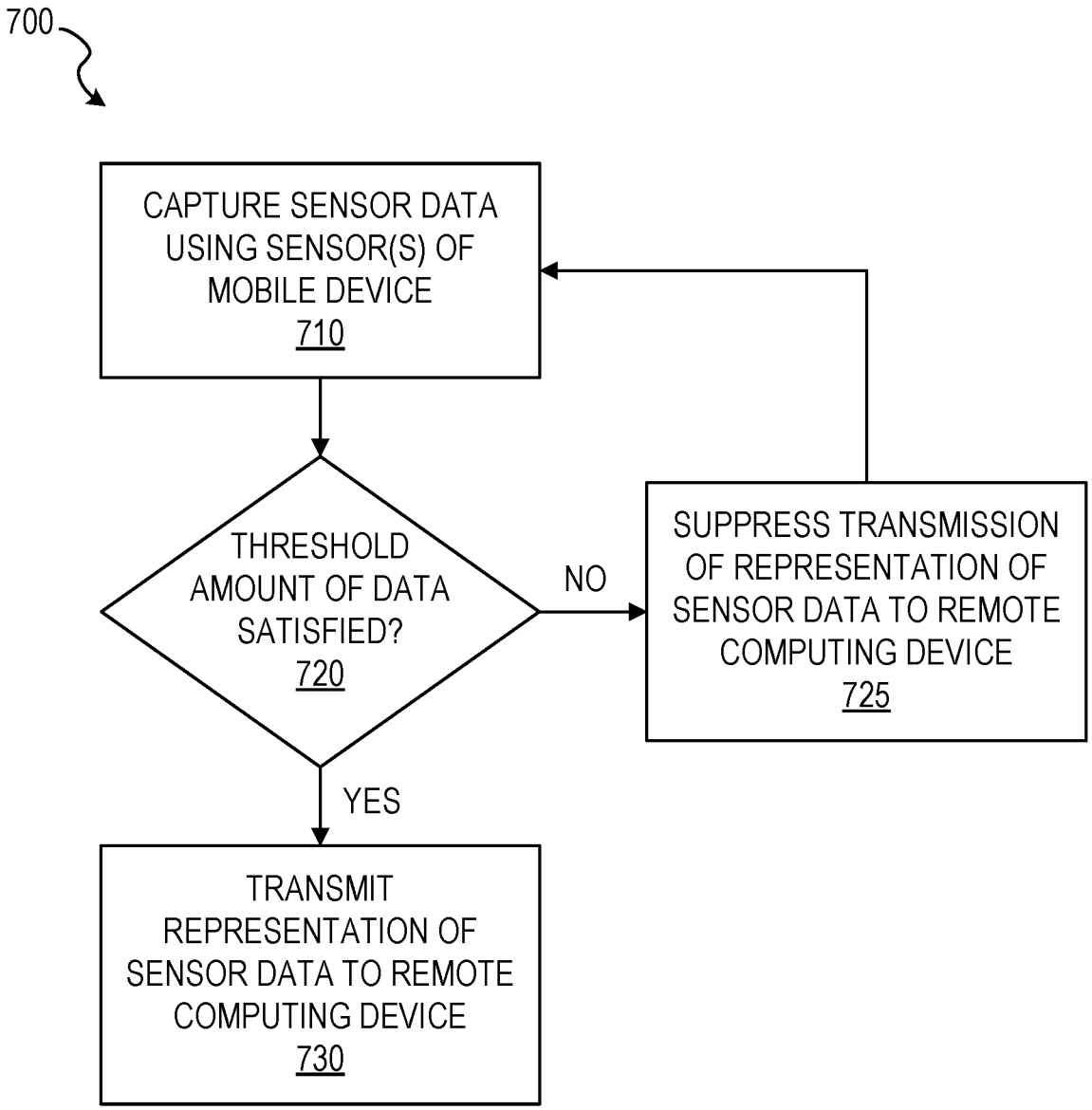
FIG. 7 is a flowchart illustrating another method of reporting location information of a user, in accordance with some example embodiments.

FIG. 7 is a flowchart illustrating another method 700 of reporting location information of a user 110, in accordance with some example embodiments. Method 700 can be performed by processing logic that can comprise hardware (e.g., circuitry, dedicated logic, programmable logic, microcode, etc.), software (e.g., instructions run on a processing device), or a combination thereof. In one example embodiment, the method 700 is performed by the reporting system 245 of FIGS. 2 and 3, or any combination of one or more of its components or modules, as described above.

At operation 710, the mobile device 112 captures sensor data using the sensor(s) 210 of the mobile device. At operation 720, the reporting system 245 determines whether or not the sensor data satisfies a predetermined threshold amount of data.

If, at operation 720, it is determined that the sensor data does not satisfy the predetermined threshold amount of data, then the reporting system 245 suppresses transmission of a representation of the sensor data to the remote computing device 130 at operation 725. In some example embodiments, the reporting system 245 stored the sensor data in memory 220. The method 700 may then return to operation 710, where additional sensor data is captured using the sensor(s) 210 of the mobile device 112.

If, at operation 720, it is determined that the sensor data does satisfy the predetermined threshold amount of data, then the reporting system 245 transmits a representation of the sensor data to the remote computing device 130 at operation 730. In some example embodiments, the reporting system 245 includes previously stored sensor data in the representation of sensor data that is transmitted to the remote computing device 130. The reporting system 245 may include the previously stored sensor data based on a determination that it is relevant, as previously discussed.

It is contemplated that any of the other features described within the present disclosure can be incorporated into method 700.

Example Mobile Device

Figure 8:
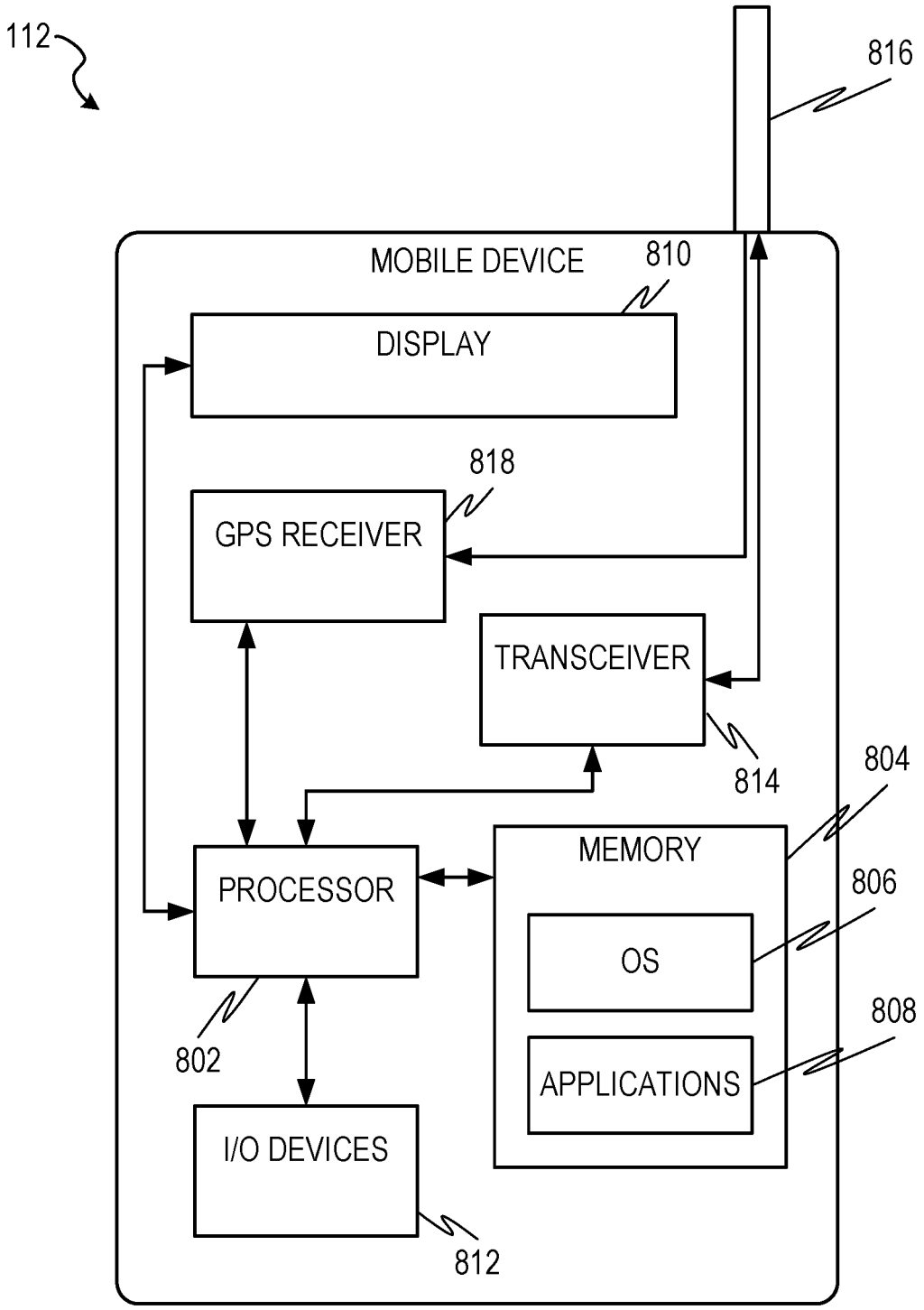
FIG. 8 is a block diagram illustrating a mobile device, in accordance with some example embodiments.

FIG. 8 is a block diagram illustrating a mobile device 112, according to an example embodiment. The mobile device 112 can include a processor 802. The processor 802 can be any of a variety of different types of commercially available processors suitable for mobile devices 112 (for example, an XScale architecture microprocessor, a Microprocessor without Interlocked Pipeline Stages (MIPS) architecture processor, or another type of processor). A memory 804, such as a random access memory (RAM), a Flash memory, or other type of memory, is typically accessible to the processor 802. The memory 804 can be adapted to store an operating system (OS) 806, as well as application programs 808, such as a mobile location-enabled application that can provide location-based services (LBSs) to a user. The processor 802 can be coupled, either directly or via appropriate intermediary hardware, to a display 810 and to one or more input/output (I/O) devices 812, such as a keypad, a touch panel sensor, a microphone, and the like. Similarly, in some embodiments, the processor 802 can be coupled to a transceiver 814 that interfaces with an antenna 816. The transceiver 814 can be configured to both transmit and receive cellular network signals, wireless data signals, or other types of signals via the antenna 816, depending on the nature of the mobile device 112. Further, in some configurations, a GPS receiver 818 can also make use of the antenna 816 to receive GPS signals. In some example embodiments, the mobile device 112 in FIG. 8 incorporates the features and components of the mobile device 112 discussed with respect to FIGS. 2-4.

Modules, Components and Logic

Certain embodiments are described herein as including logic or a number of components, modules, or mechanisms. Modules may constitute either software modules (e.g., code embodied (1) on a non-transitory machine-readable medium or (2) in a transmission signal) or hardware-implemented modules. A hardware-implemented module is tangible unit capable of performing certain operations and may be configured or arranged in a certain manner. In example embodiments, one or more computer systems (e.g., a standalone, client or server computer system) or one or more processors may be configured by software (e.g., an application or application portion) as a hardware-implemented module that operates to perform certain operations as described herein.

In various embodiments, a hardware-implemented module may be implemented mechanically or electronically. For example, a hardware-implemented module may comprise dedicated circuitry or logic that is permanently configured (e.g., as a special-purpose processor, such as a field programmable gate array (FPGA) or an application-specific integrated circuit (ASIC)) to perform certain operations. A hardware-implemented module may also comprise programmable logic or circuitry (e.g., as encompassed within a general-purpose processor or other programmable processor) that is temporarily configured by software to perform certain operations. It will be appreciated that the decision to implement a hardware-implemented module mechanically, in dedicated and permanently configured circuitry, or in temporarily configured circuitry (e.g., configured by software) may be driven by cost and time considerations.

Accordingly, the term "hardware-implemented module" should be understood to encompass a tangible entity, be that an entity that is physically constructed, permanently configured (e.g., hardwired) or temporarily or transitorily configured (e.g., programmed) to operate in a certain manner and/or to perform certain operations described herein. Considering embodiments in which hardware-implemented modules are temporarily configured (e.g., programmed), each of the hardware-implemented modules need not be configured or instantiated at any one instance in time. For example, where the hardware-implemented modules comprise a general-purpose processor configured using software, the general-purpose processor may be configured as respective different hardware-implemented modules at different times. Software may accordingly configure a processor, for example, to constitute a particular hardware-implemented module at one instance of time and to constitute a different hardware-implemented module at a different instance of time.

Hardware-implemented modules can provide information to, and receive information from, other hardware-implemented modules. Accordingly, the described hardware-implemented modules may be regarded as being communicatively coupled. Where multiple of such hardware-implemented modules exist contemporaneously, communications may be achieved through signal transmission (e.g., over appropriate circuits and buses) that connect the hardware-implemented modules. In embodiments in which multiple hardware-implemented modules are configured or instantiated at different times, communications between such hardware-implemented modules may be achieved, for example, through the storage and retrieval of information in memory structures to which the multiple hardware-implemented modules have access. For example, one hardware-implemented module may perform an operation, and store the output of that operation in a memory device to which it is communicatively coupled. A further hardware-implemented module may then, at a later time, access the memory device to retrieve and process the stored output. Hardware-implemented modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but deployed across a number of machines. In some example embodiments, the processor or processors may be located in a single location (e.g., within a home environment, an office environment or as a server farm), while in other embodiments the processors may be distributed across a number of locations.

The one or more processors may also operate to support performance of the relevant operations in a "cloud computing" environment or as a "software as a service" (SaaS). For example, at least some of the operations may be performed by a group of computers (as examples of machines including processors), these operations being accessible via a network (e.g., the Internet) and via one or more appropriate interfaces (e.g., Application Program Interfaces (APIs).)

Electronic Apparatus and System

Example embodiments may be implemented in digital electronic circuitry, or in computer hardware, firmware, software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor, a computer, or multiple computers.

A computer program can be written in any form of programming language, including compiled or interpreted languages, and it can be deployed in any form, including as a stand-alone program or as a module, subroutine, or other unit suitable for use in a computing environment. A computer program can be deployed to be executed on one computer or on multiple computers at one site or distributed across multiple sites and interconnected by a communication network.

In example embodiments, operations may be performed by one or more programmable processors executing a computer program to perform functions by operating on input data and generating output. Method operations can also be performed by, and apparatus of example embodiments may be implemented as, special purpose logic circuitry, e.g., a field programmable gate array (FPGA) or an application-specific integrated circuit (ASIC).

The computing system can include clients and servers. A client and server are generally remote from each other and typically interact through a communication network. The relationship of client and server arises by virtue of computer programs running on the respective computers and having a client-server relationship to each other. In embodiments deploying a programmable computing system, it will be appreciated that that both hardware and software architectures merit consideration. Specifically, it will be appreciated that the choice of whether to implement certain functionality in permanently configured hardware (e.g., an ASIC), in temporarily configured hardware (e.g., a combination of software and a programmable processor), or a combination of permanently and temporarily configured hardware may be a design choice. Below are set out hardware (e.g., machine) and software architectures that may be deployed, in various example embodiments.

Example Machine Architecture and Machine-Readable Medium

Figure 9:
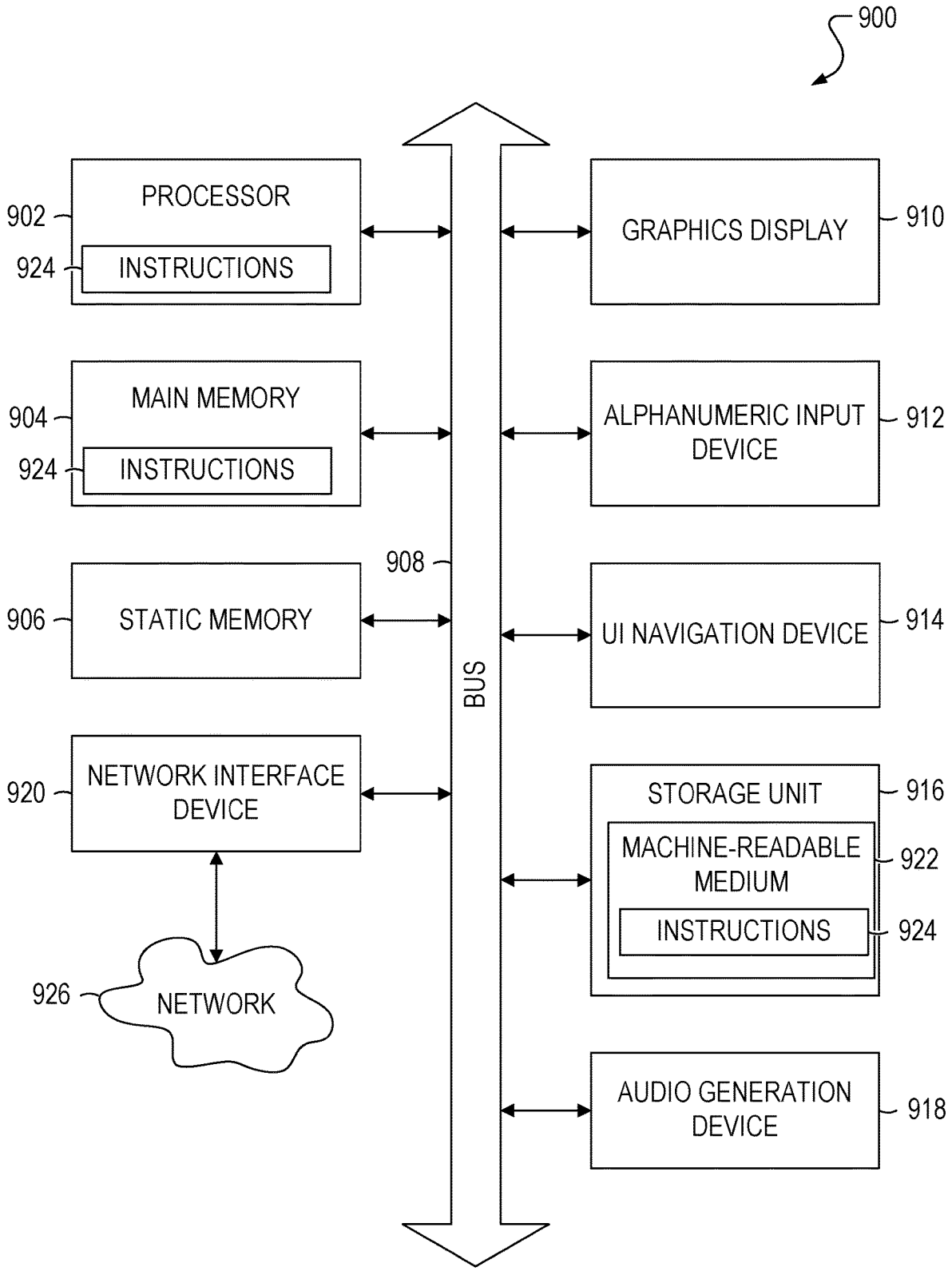
FIG. 9 is a block diagram of an example computer system on which methodologies described herein may be executed, in accordance with some example embodiments.

FIG. 9 is a block diagram of an example computer system 900 on which methodologies described herein may be executed, in accordance with an example embodiment. In alternative embodiments, the machine operates as a stand-alone device or may be connected (e.g., networked) to other machines. In a networked deployment, the machine may operate in the capacity of a server or a client machine in server-client network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 900 includes a processor 902 (e.g., a central processing unit (CPU), a graphics processing unit (GPU) or both), a main memory 904 and a static memory 906, which communicate with each other via a bus 908. The computer system 900 may further include a graphics display unit 910 (e.g., a liquid crystal display (LCD) or a cathode ray tube (CRT)). The computer system 900 also includes an alphanumeric input device 912 (e.g., a keyboard or a touch-sensitive display screen), a user interface (UI) navigation device 914 (e.g., a mouse), a storage unit 916, a signal generation device 918 (e.g., a speaker) and a network interface device 920.

Machine-Readable Medium

The storage unit 916 includes a machine-readable medium 922 on which is stored one or more sets of instructions and data structures (e.g., software) 924 embodying or utilized by any one or more of the methodologies or functions described herein. The instructions 924 may also reside, completely or at least partially, within the main memory 904 and/or within the processor 902 during execution thereof by the computer system 900, the main memory 904 and the processor 902 also constituting machine-readable media.

While the machine-readable medium 922 is shown in an example embodiment to be a single medium, the term "machine-readable medium" may include a single medium or multiple media (e.g., a centralized or distributed database, and/or associated caches and servers) that store the one or more instructions 924 or data structures. The term "machine-readable medium" shall also be taken to include any tangible medium that is capable of storing, encoding or carrying instructions (e.g., instructions 924) for execution by the machine and that cause the machine to perform any one or more of the methodologies of the present disclosure, or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including by way of example semiconductor memory devices, e.g., Erasable Programmable Read-Only Memory (EPROM), Electrically Erasable Programmable Read-Only Memory (EEPROM), and flash memory devices; magnetic disks such as internal hard disks and removable disks; magneto-optical disks; and CD-ROM and DVD-ROM disks.

Transmission Medium

The instructions 924 may further be transmitted or received over a communications network 926 using a transmission medium. The instructions 924 may be transmitted using the network interface device 920 and any one of a number of well-known transfer protocols (e.g., HTTP). Examples of communication networks include a local area network ("LAN"), a wide area network ("WAN"), the Internet, mobile telephone networks, Plain Old Telephone Service (POTS) networks, and wireless data networks (e.g., WiFi and WiMax networks). The term "transmission medium" shall be taken to include any intangible medium that is capable of storing, encoding or carrying instructions for execution by the machine, and includes digital or analog communications signals or other intangible media to facilitate communication of such software.

Although an embodiment has been described with reference to specific example embodiments, it will be evident that various modifications and changes may be made to these embodiments without departing from the broader spirit and scope of the present disclosure. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A computer-implemented method comprising:

capturing, by at least one hardware processor on a mobile device, first sensor data at a first time using at least one sensor of the mobile device;

determining, by the at least one hardware processor, that a predetermined hazard criteria is satisfied by an environment of a user of the mobile device in a first determination instance, the predetermined hazard criteria being configured to indicate that a hazardous condition is present within the environment of the user of the mobile device;

determining, by the at least one hardware processor, that the first sensor data does not satisfy a predetermined threshold amount of data, the predetermined threshold amount of data comprises a minimum amount of geographic area represented in sensor data;

suppressing, by the at least one hardware processor, transmission of a representation of the captured first sensor data to a remote computing device based on the determination that the predetermined threshold amount of data is not satisfied by the first sensor data;

capturing, by the at least one hardware processor, second sensor data at a second time different from the first time using the at least one sensor of the mobile device, the second time being after the first time;

determining, by the at least one processor, that the predetermined hazard criteria is satisfied by the environment of the user of the mobile device in a second determination instance different from the first determination instance;

determining, by the at least one processor, that a combination of the first sensor data and the second sensor data satisfies the predetermined threshold amount of data; and transmitting, by the at least one hardware processor, a representation of the combination of the first sensor data and the second sensor data to the remote computing device based on the determination that the predetermined hazard criteria is satisfied by the environment of the user of the mobile device in the second determination instance and the determination that the combination of the first sensor data and the second sensor data satisfy the predetermined threshold amount of data.

2. The computer-implemented method of claim 1, wherein the first sensor data comprises first inertial measurement unit (IMU), the second sensor data comprises second IMU data, and the at least one sensor comprises an IMU.

3. The computer-implemented method of claim 1, wherein the first sensor data further comprises first image data, the second sensor data further comprises second image data, and the at least one sensor further comprises at least one camera.

4. The computer-implemented method of claim 1, wherein the predetermined hazard criteria comprises at least one indication from a group of indication consisting of an indication that smoke has been detected, an indication that a predetermined threshold temperature has been exceeded, an indication that a flame has been detected, an indication that a particular gas has been detected, and an indication that radiation has been detected.

5. The computer-implemented method of claim 1, wherein the determining that the predetermined hazard criteria is satisfied by the environment of the user of the mobile device comprises:

receiving hazardous condition data from at least one detector from a group of detectors consisting of a smoke detector, a heat detector, a flame detector, a gas detector, a carbon monoxide detector, and a radiation detector; and determining that the predetermined hazard criteria is satisfied by the hazardous condition data.

6. The computer-implemented method of claim 5, wherein the at least one detector is integrated into the mobile device.

7. The computer-implemented method of claim 1, wherein the mobile device comprises one of a physical badge, a smartphone, a tablet computer, a smartwatch, and a head-mounted display device.

8. The computer-implemented method of claim 1, wherein the transmitting of the representation of the captured second sensor data to the remote computing device comprises:

identifying relevant sensor data based on a determination that the relevant sensor data was captured by the at least one sensor within a predetermined period of time, the identified relevant sensor data comprising the first sensor data and the second sensor data; and transmitting a representation of the identified relevant sensor data to the remote computing device.

9. The computer-implemented method of claim 8, wherein the transmitting the representation of the identified relevant sensor data comprises compressing the identified relevant sensor data, and transmitting the compressed identified relevant sensor data to the remote computing device.

10. The computer-implemented method of claim 1, wherein the remote computing device comprises a remote server.

11. A system comprising:

a mobile device;

at least one sensor on the mobile device;

at least one processor on the mobile device; and a non-transitory machine-readable medium, on the mobile device, storing executable instructions that, when executed, cause the at least one processor to perform operations comprising:

capturing first sensor data at a first time using at the least one sensor;

determining that a predetermined hazard criteria is satisfied by an environment of a user of the mobile device in a first determination instance, the predetermined hazard criteria being configured to indicate that a hazardous condition is present within the environment of the user of the mobile device;

determining that the first sensor data does not satisfy a predetermined threshold amount of data, the predetermined threshold amount of data comprises a minimum amount of geographic area represented in sensor data;

suppressing transmission of a representation of the captured first sensor data to a remote computing device based on the determination that the predetermined threshold amount of data is not satisfied by the first sensor data;

capturing second sensor data at a second time different from the first time using the at least one sensor of the mobile device, the second time being after the first time;

determining that the predetermined hazard criteria is satisfied by the environment of the user of the mobile device in a second determination instance different from the first determination instance;

determining that a combination of the first sensor data and the second sensor data satisfies the predetermined threshold amount of data; and transmitting a representation of the combination of the first sensor data and the second sensor data to the remote computing device based on the determination that the predetermined hazard criteria is satisfied by the environment of the user of the mobile device in the second determination instance and the determination that the combination of the first sensor data and the second sensor data satisfy the predetermined threshold amount of data.

12. The system of claim 11, wherein the first sensor data comprises first inertial measurement unit (IMU), the second sensor data comprises second IMU data, and the at least one sensor comprises an IMU.

13. The system of claim 11, wherein the first sensor data further comprises first image data, the second sensor data further comprises second image data, and the at least one sensor further comprises at least one camera.

14. The system of claim 11, wherein the predetermined hazard criteria comprises at least one indication from a group of indication consisting of an indication that smoke has been detected, an indication that a predetermined threshold temperature has been exceeded, an indication that a flame has been detected, an indication that a particular gas has been detected, and an indication that radiation has been detected.

15. The system of claim 11, wherein the determining that the predetermined hazard criteria is satisfied by the environment of the user of the mobile device comprises receiving hazardous condition data from at least one detector from a group of detectors consisting of a smoke detector, a heat detector, a flame detector, a gas detector, a carbon monoxide detector, and a radiation detector.

16. The system of claim 11, wherein the mobile device comprises one of a physical badge, a smartphone, a tablet computer, a smartwatch, and a head-mounted display device.

17. The system of claim 11, wherein the transmitting of the representation of the captured second sensor data to the remote computing device comprises:

identifying relevant sensor data based on a determination that the relevant sensor data was captured by the at least one sensor within a predetermined period of time, the identified relevant sensor data comprising the first sensor data and the second sensor data; and transmitting a representation of the identified relevant sensor data to the remote computing device.

18. A non-transitory machine-readable medium storing executable instructions that, when executed, cause the at least one processor to perform operations comprising:

capturing first sensor data at a first time using at the least one sensor of a mobile device;

determining that a predetermined hazard criteria is satisfied by an environment of a user of the mobile device in a first determination instance, the predetermined hazard criteria being configured to indicate that a hazardous condition is present within the environment of the user of the mobile device;

determining that the first sensor data does not satisfy a predetermined threshold amount of data, the predetermined threshold amount of data comprises a minimum amount of geographic area represented in sensor data;

suppressing transmission of a representation of the captured first sensor data to a remote computing device based on the determination that the predetermined threshold amount of data is not satisfied by the first sensor data;

capturing second sensor data at a second time different from the first time using the at least one sensor of the mobile device, the second time being after the first time;

determining that the predetermined hazard criteria is satisfied by the environment of the user of the mobile device in a second determination instance different from the first determination instance;

determining, by the at least one processor, that a combination of the first sensor data and the second sensor data satisfies the predetermined threshold amount of data; and transmitting a representation of the combination of the first sensor data and the second sensor data to the remote computing device based on the determination that the predetermined hazard criteria is satisfied by the environment of the user of the mobile device in the second determination instance and the determination that the combination of the first sensor data and the second sensor data satisfy the predetermined threshold amount of data.

19. The computer-implemented method of claim 1, wherein the minimum amount of geographic area represented in the sensor data comprises a minimum amount of continuous distance traversal.

* * * * *